United States Patent [19]

Krieger

[11] Patent Number: 4,506,414

[45] Date of Patent: Mar. 26, 1985

[54] YARN-DRAFTING APPARATUS

[75] Inventor: Klaus E. Krieger, Kirchheim, Fed. Rep. of Germany

[73] Assignee: Zinser Textilmaschinen GmbH, Ebersbach, Fed. Rep. of Germany

[21] Appl. No.: 465,991

[22] Filed: Feb. 11, 1983

[30] Foreign Application Priority Data

Feb. 18, 1982 [DE] Fed. Rep. of Germany ..... 3205880

[51] Int. Cl.[3] ..... D01H 5/32

[52] U.S. Cl. ..... 19/240; 19/258

[58] Field of Search ..... 19/239, 240, 258, 260, 19/259; 57/93, 94, 95, 100, 97

[56] References Cited

U.S. PATENT DOCUMENTS

| | | | |
|---|---|---|---|
| 2,682,144 | 6/1954 | Hare | 19/240 X |
| 2,981,986 | 5/1961 | Neil | 19/240 |
| 3,012,288 | 12/1961 | Werner | 19/240 |
| 3,088,175 | 5/1963 | Aoki | 19/240 |
| 3,099,048 | 7/1963 | Locher | 19/240 |
| 3,289,255 | 12/1966 | Whitehurst | 19/240 |
| 3,694,861 | 10/1972 | Whitehurst | 19/259 |
| 4,336,684 | 6/1982 | Hartmannsgruber et al. | 19/240 X |
| 4,369,550 | 1/1983 | Meile | 19/240 |

FOREIGN PATENT DOCUMENTS

| | | |
|---|---|---|
| 1921248 | 2/1970 | Fed. Rep. of Germany . |
| 2912576 | 10/1979 | Fed. Rep. of Germany . |

*Primary Examiner*—Louis K. Rimrodt

*Attorney, Agent, or Firm*—Karl F. Ross; Herbert Dubno

[57] ABSTRACT

An apparatus used in combination with a yarn spinner has an upstream gripper roller assembly including at least an upstream roller pair gripping the yarn to be stretched, a downstream gripper roller assembly including at least a downstream roller pair spaced from the upstream pair and also gripping the yarn, and respective variable-speed drives connected to the upstream and downstream pairs for rotating same at respective slow downstream and fast upstream speeds and thereby passing the yarn from the downstream to the upstream pair while stretching it. Respective upstream and downstream sensors juxtaposed with the yarn adjacent the upstream and downstream roller pairs measure the yarn size and respective upstream and downstream controllers connected to the respective sensors and drives rotate the respective roller pairs at speeds dependent on the respective detected yarn sizes.

8 Claims, 8 Drawing Figures

YARN-DRAFTING APPARATUS

FIELD OF THE INVENTION

The present invention relates to the stretching, i.e. drafting and spinning of a filament or yarn. More particularly this invention concerns a yarn-stretching apparatus used immediately upstream of a spinner.

BACKGROUND OF THE INVENTION

It is known to stretch a yarn, by which is meant a filament formed of a multiplicity of fibers, by passing it between at least two gripper-roller assemblies that each include at least two gripper rollers and that operate at different speeds to stretch the yarn longitudinally in at least one stretching zone. A sensor is juxtaposed with the yarn and is connected through an appropriate controller and drive to one of the roller assemblies so that its speed can be varied to increase the stretch in the yarn when its mass increases at the measuring location and to decrease it when its mass decreases. In this manner irregularities in the size and weight of the yarn can be eliminated.

Operating speeds have increased in recent times to levels which make this system fairly ineffective, as an intolerably thick or thin portion of yarn can pass through to the spinner before corrective action can be taken. No matter how sensitive and fast-acting the sensor is, it is impossible to obtain fast enough reaction from the mechanical drive elements to produce a product of high uniformity when working at such high speed.

German patent document No. 2,912,576 based on Swiss application No. 4497-78 filed Apr. 26, 1978 by W. Grunder describes a system having sensors at several locations forming an input for a controller/drive unit that in turn can control the rotation rates of several different roller assemblies. One sensor is constructed to detect short-period variations and the other long-period variations and both produce outputs that are combined by the controller/drive to control the operation rate of a single stretch zone. The operation speed of such a system is still regrettably slow.

A carding system is seen in German patent document No. 1,921,248 based on Swiss application No. 9728-68 filed June 28, 1968 by E. Felix. This arrangement uses short-period and long-period sensors which act on different stretching zones. Similarly a fluted-roll arrangement is seen in U.S. Pat. No. 3,694,861 of J. Whitehurst wherein short-period mass variations in a sliver being stretched are detected and responded to.

None of these systems is capable of producing a product that not only is uniform, but uniform at a particular size or yarn number. Thus some can produce a relatively uniform product, but one whose gauge will vary over a long period within a fairly wide range, while others will produce a yarn whose gauge will vary rapidly and often in a relatively narrow range.

OBJECTS OF THE INVENTION

It is therefore an object of the present invention to provide an improved yarn-stretching apparatus.

Another object is the provision of such a yarn-stretching apparatus which overcomes the above-given disadvantages.

Yet another object it to provide a high-speed yarn-stretching apparatus which can produce a stretched yarn of uniform size and virtually unvarying gauge.

SUMMARY OF THE INVENTION

These objects are attained according to the instant invention in an apparatus used in combination with a yarn spinner and having an upstream gripper roller assembly including at least an upstream roller pair gripping the yarn to be stretched, a downstream gripper roller assembly including at least a downstream roller pair spaced from the upstream pair and also gripping the yarn, and respective variable-speed drive means connected to the upstream and downstream pairs for rotating same at respective slow upstream and fast downstream speeds and thereby passing the yarn from the upstream to the downstream pair while stretching it. Respective upstream and downstream sensor means juxtaposed with the yarn adjacent the upstream and downstream roller pairs measure the yarn size and respective upstream and downstream control means connected to the respective sensors and drive means rotate the respective roller pairs at speeds dependent on the respective detected yarn sizes.

The system of this invention therefore uses roller assemblies, which of course each can comprise more than two rollers for maximum gripping effect, which are separately controlled. Feedback-type control can be used to eliminate long-period size variations, and non-feedback control is used for the short-period size variations.

According to this invention the upstream sensor is upstream of the upstream assembly. This is the nonfeedback system. The downstream sensor is downstream of the downstream assembly, so that this subsystem works without feedback.

For close yarn-size control the system further has an intermediate gripper roller assembly including at least an intermediate roller pair engaging the yarn between the upstream and downstream assemblies and intermediate drive means for rotating the intermediate rollers and thereby advancing and stretching the yarn. In one arrangement the intermediate drive means rotates the intermediate rollers at a fixed speed. In this arrangement the downstream sensor is downstream of the downstream assembly.

It is also possible for such an arrangement to include another intermediate roller pair gripping the yarn downstream of the first-mentioned intermediate roller pair and upstream of the downstream roller pair. The intermediate drive means rotates both intermediate roller pairs at constant speeds with the other intermediate pair rotating more slowly than the first intermediate pair. In this system the downstream sensor can lie between the intermediate roller pairs.

In another system according to this invention each of the roller assemblies includes a second such pair of gripper rollers and the drive means includes a transmission for rotating the second roller pair of each assembly at a speed forming a fixed ratio with the speed of the other roller pair of the respective assembly, with the speeds increasing in the yarn-travel direction. In such a system the downstream sensor means can be between the roller pairs of the downstream assembly.

The system of this invention can also have another gripper roller assembly including at least another roller pair engaging the yarn upstream of the upstream assembly and intermediate drive means for rotating the rollers of the other pair at a fixed speed slower than that of the upstream rollers. The downstream drive means of this system includes means for increasing and decreasing the rotation rate of the downstream rollers proportionately as that of the upstream rollers increases and decreases. This means can include an electrical link or a variable-speed transmission connected to and operated by the downstream control means.

It is also possible for the system of this invention to comprise, as described above, an upstream gripper roller assembly including at least an upstream roller pair gripping the yarn to be stretched, a downstream gripper roller assembly including at least a downstream roller pair spaced from the upstream pair and also gripping the yarn, a variable-speed drive means connected to the rollers of one of the assemblies for rotating the respective rollers and thereby passing the yarn from the downstream to the upstream assembly while stretching the yarn, and sensor means juxtaposed with the yarn adjacent the roller pair of the one assembly for determining the yarn size. Control means connected to the sensor and drive means rotates the roller pair of the one assembly at a speed dependent on the detected yarn sizes and means at the other roller assembly stretches the yarn thereat relatively greatly when it is relatively thick and for stretching it relatively little when it is relatively thin.

This stretching means at the other assembly includes a pair of fluted rollers downstream of the gripper rollers of the other assembly. As is known, the yarn slips between the fluted rollers to an extent generally inversely proportional to its thickness, catching and slipping relatively little when it is thick and slipping easily when it is thin. Thus these rollers comprise an automatic and very cheap and efficient short-period size adjustment system. In this assembly it is possible for the one assembly to be either downstream or upstream of the other. In any case the fluted rollers are upstream of the respective gripper rollers and the stretching means at the other assembly includes means for rotating the fluted rollers at a peripheral speed smaller than that of the respective gripper rollers.

DESCRIPTION OF THE DRAWING

The above and other features and advantages will become more readily apparent from the following, reference being made to the accompanying drawing in which.

SPECIFIC DESCRIPTION

Figure 1:
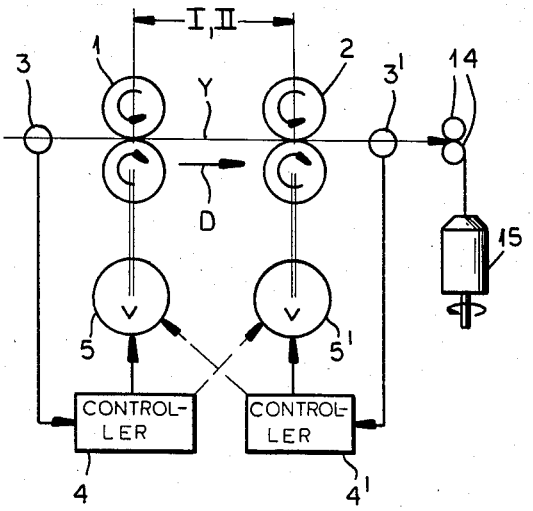
FIG. 1 is a schematic view of the yarn-stretching and -spinning system of the invention.

As seen in FIG. 1 a yarn or filament Y passes in a direction D between an upstream pair of pinch rollers 1 and a downstream pair of pinch rollers 2, then through two drive rollers 14 to a spinning-takeup spool 15 of conventional design. The yarn Y is formed of a multiplicity of parallel filaments or fibers and is stretched as it passes through the zone I, II between the two pairs of rollers 1 and 2.

To this end the rollers 1 are rotated at a variable speed v by a drive 5 regulated by a controller 4 provided with a weight, mass, or size sensor 3 downstream in the direction D from the rollers 1 and serving as is known to generate an output proportional to the bulk or mass of the yarn Y at this location. The upstream rollers 2 are similarly driven by a variable-speed motor 5' operated from a controller 4' provided with a sensor 3' downstream of these rollers 2. The controllers 4 and 4' regulate the variable speeds v of the respective drives 5 and 5' so that the mass or size detected by the respective sensors 3 and 3' corresponds to a given mass or size. Clearly the downstream control-drive 4'-5' operates with feedback, that is its reading will reflect an adjustment in a controlled value it has made, whereas the upstream control-drive 4-5 operates without feedback. An appropriate delay can be provided in the feedback circuit to eliminate hunting.

FIG. 1 also indicates in dashed likes how the controller 4 can be used to regulate the motor 5' and/or the controller 4' can regulate the motor 5.

This arrangement is the simplest one according to this invention, and normally functions with the two subsystems 3-5 and 3'-5' operating independently of one another. In this manner short-period variations are responded to rapidly at the upstream roller pair 1 and long-period ones at the downstream pair 2, giving a yarn Y of almost perfect uniformity and conformity to a desired size.

Figure 2:
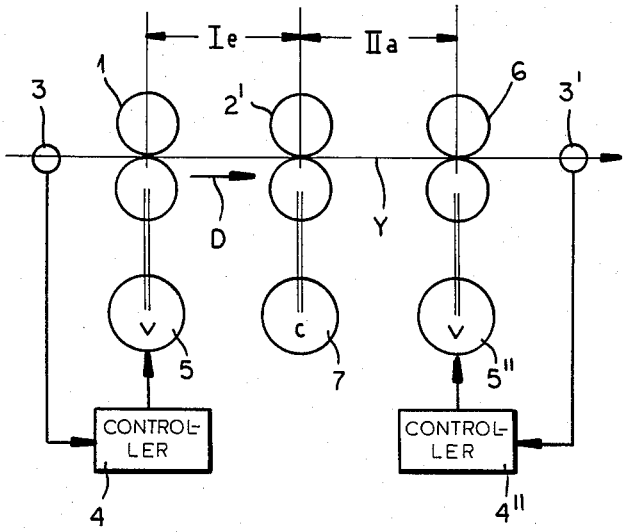
FIGS. 2–8 are views like FIG. 1 but showing different systems in accordance with the present invention.

Structure in the arrangement of FIG. 2 that is identical with structure of FIG. 1 is identified with the same reference numerals and letters. In this arrangement, however, the downstream roller pair 2 is replaced by an intermediate roller pair 2' and a downstream pair 6, the former driven at a constant speed c by a drive motor 7 and the latter by a variable-speed drive motor 5''. Thus the stretching zone between the furthest downstream rollers 1, driven as in FIG. 1 by a variable-speed motor 5 regulated by a controller 4 from an upstream sensor 3, and the furthest upstream rollers 6 is subdivided into a downstream prestretching zone Ie and an upstream main stretching zone IIa. The downstream drive motor 5'' is operated by a respective controller 4'' from the sensor 3', just as in FIG. 1.

This arrangement is advantageous in that it prevents the two size-controlling processes from interfering with each other. Seeing that the strand or yarn Y is moving at the fixed speed c in the center of the system, the prestretching and main stretching are wholly independent of each other.

Figure 3:
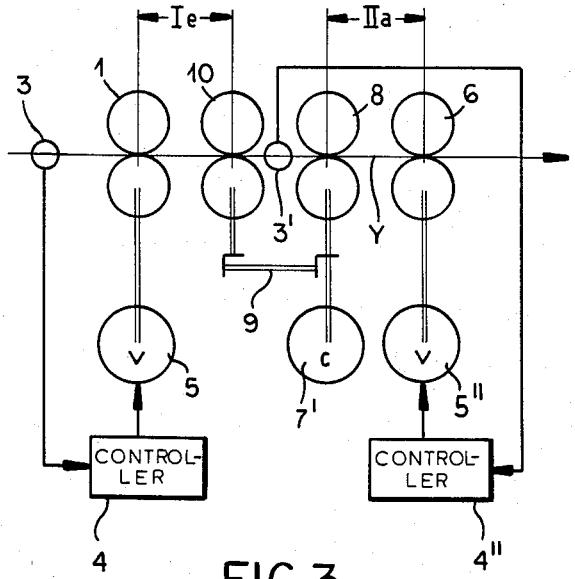

This principle is carried one step further in FIG. 3 where two constant-speed roller pairs 8 and 10 are provided between the downstream and upstream rollers 1 an 6. A drive 7' operating at a constant speed c is connected through a no-slip transmission 9 to these rollers 8 and 10 so that the rollers 10 always operate somewhat more slowly than the rollers 8. The prestretching and main stretching zones Ie and IIa are thereby wholly separated from each other. Furthermore the upstream zone Ie is wholly separated from the downstream zone IIa by an intermediate zone in which a predetermined and unvarying amount of stretch is imparted to the yarn Y. In this system also the downstream mass sensor 3' is provided in this intermediate region, upstream of the main-stretching zone IIa, so each control subsystem 3, 4, 5 and 3', 4'', 5'' operates without internal feedback. The intermediate zone between the rollers 8 and 10 can also serve to narrow or compact the strand Y which normally widens as it is stretched. Thus the yarn Y is stretched in three zones in the outer two of which the amount of stretch is variable.

Figure 4:
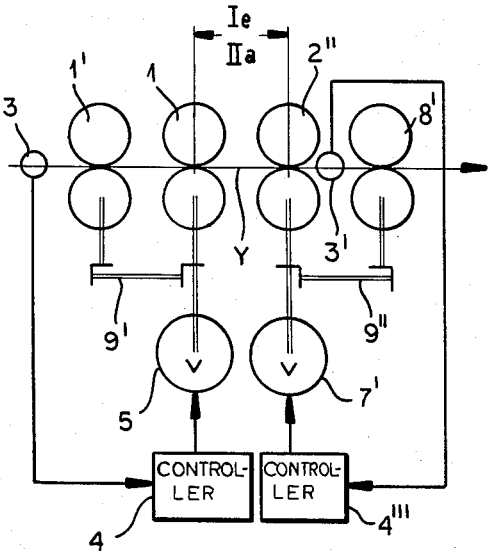

Along the same lines, FIG. 4 shows an arrangement which is a combination of that of FIGS. 1 and 3, that is four pairs of rollers follow each other from extreme upstream rollers 1' through intermediate upstream and downstream rollers 1 and 2'' to extreme downstream rollers 8'. The rollers 1 and 1' are driven differentially through a no-slip transmission 9' from the variable-speed drive motor 5 regulated in turn by the controller 4 of the sensor 3. The downstream rollers 2'' and 8' are driven differentially by a no-slip transmission 9'' from the downstream variable-speed drive 7' operated by a controller 4''' having a sensor 3' between the rollers 2'' and 8'. In this manner the two stretch zones Ie and IIa lie between the intermediate rollers 1 and 2'', but the yarn Y is stretched both upstream and downstream and the mass is detected and the speeds varied in the same manner as in FIG. 1. Stretching therefore takes place in three zones, the central one of which can impart variable stretch.

Figure 5:
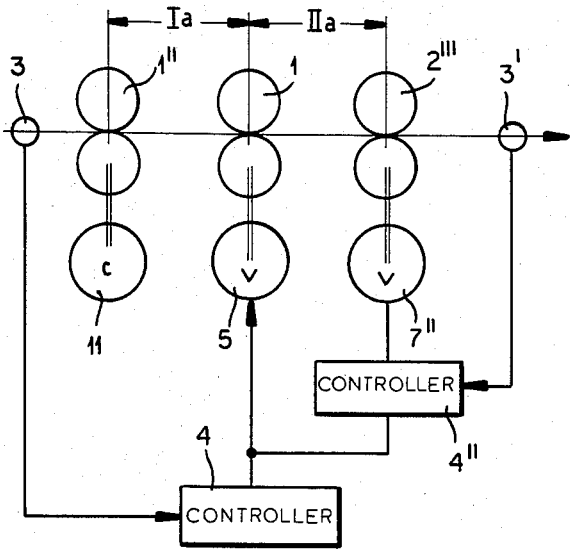

The system of FIG. 5 has upstream rollers 1'' driven by a constant-speed drive motor 11, intermediate rolls 1 driven as in FIG. 1 by a variable-speed motor 5 regulated by a controller 4 having a downstream sensor 3, and downstream rollers 2''' also driven by a variable-speed motor 7'' from a controller 4'' having the downstream sensor 3'. In this arrangement a prestretching zone Ia is formed with a constant starting speed and a main-stretching zone IIa with variable starting and ending speeds. A connection from the output of the controler 4 to an input of the controller 4'' insures that the rollers 2''' are always speeded and slowed with the rollers 1. Such an arrangement therefore prevents the controller 4'' from having to compensate via the feedback route for variations in the speed of the rollers 1.

Figure 6:
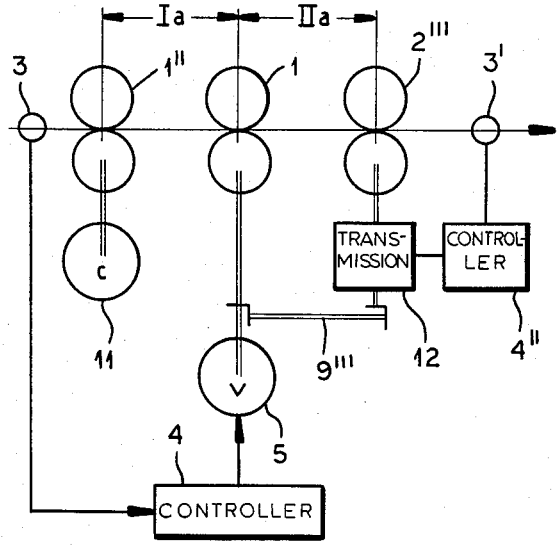

FIG. 6 shows an arrangement in principle identical to that of FIG. 5. Here, however, the extreme downstream rollers 2''' are driven by a variable-speed transmission 12 through a mechanical step-up linkage or transmission 9'''0 from the variable-speed drive motor 5 of the middle rollers 1. The controller 4'' here acts on this transmission 12, so that a mechanical link replaces the electronic one of FIG. 5 between the two controllers 4 and 4''. Thus when the controller 4 speeds up or slows down the rollers 1 in response to a variation detected at 3, the rollers 2''' will automatically be correspondingly speeded or slowed, thereby not falsifying a setting previously arrived at by the controller 4''.

Figure 7:
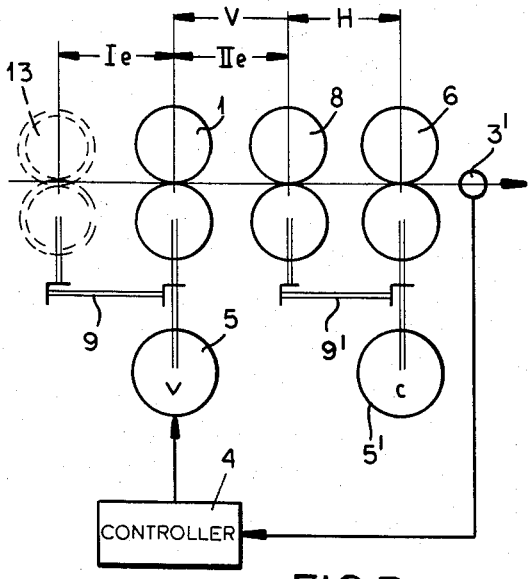

The arrangement of FIG. 7 replaces one of the control subassemblies, such as shown at 3-5 in FIG. 1, with a grooved- or fluted-wheel roller pair 13 driven via a fixed-stepdown transmission 9 from the downstream-roller drive motor 5 that is operated through its controller 4 from the downstream sensor 3'. The downstream roller pair 6 is driven at a fixed speed c from a fixed-speed drive motor 5'' that is also connected through a stepdown transmission 9' to the rollers 8. This forms a regulated stretch zone Ie with variable speed and a main-stretch zone IIe which also is of varible speed. This latter zone IIe corresponds to a second prestretch zone V followed by a fixed-rate and -speed main-stretch zone H between the rollers 6 and 8.

Figure 8:
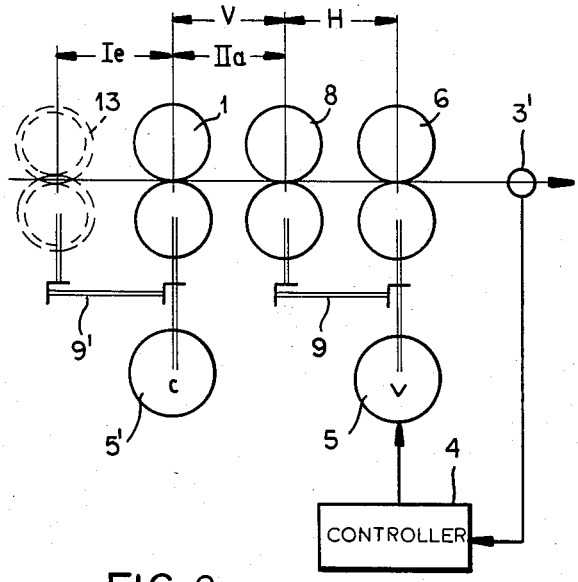

Along similar lines FIG. 8 shows a substantially identical system, but wherein the upstream rolls 1 and 13 are operated at the constant speed c by the drive 5' and the downstream rollers 6 and 8 at a variable speed v by the drive 5. This construction creates a variable-stretch zone IIa with variable ending or output speed and a stretch zone Ie with variable input speed between the fluted rollers 13 and the pinch rollers 1. The use of such fluted rollers, as discussed in the above-cited patent documents to which reference should be made for further details, eliminates an entire regulating circuit since such rollers are inherently self-adjusting, inhibiting slip of a thick strand and permitting slip of a thin one, so that they can replace one of the control subsystems according to the invention.

With the system of this invention it is possible to produce a product whose size does not vary appreciably. Short-period variations are normally taken care of by the upstream prestretching arrangement and long-period ones by the downstream one. These short-period variations are regulated out without using feedback, that is the sensor is upstream of the size-regulating element, but the long-period ones are typically adjusted for with the aid of feedback-type control.

I claim:

1. In combination with a yarn spinner, a yarn-drafting apparatus comprising:

an upstream gripper roller assembly including at least an upstream roller pair gripping the yarn to be drafted;

a downstream gripper roller assembly including at least a downstream roller pair spaced from the upstream pair and also gripping the yarn; wherein the improvement comprises:

respective variable-speed drive means connected to the upstream and downstream pairs for rotating same substantially independently of each other at respective slow upstream and fast downstream speeds and thereby passing the yarn from the upstream to the downstream pair while drafting the yarn;

respective upstream and downstream sensor means juxtaposed with the yarn adjacent the upstream and downstream roller pairs for determining the yarn size; and respective upstream and downstream control means connected to the respective sensors and drive means for rotating the respective roller pairs at speeds dependent substantially only on the respective detected yarn sizes.

2. The yarn-drafting apparatus defined in claim 1, further comprising an intermediate gripper roller assembly including at least an intermediate roller pair engaging the yarn between the upstream and downstream assemblies; and intermediate drive means for rotating the intermediate rollers and thereby advancing and drafting the yarn.

3. The yarn-drafting apparatus defined in claim 2 wherein the intermediate drive means rotates the intermediate rollers at a fixed speed, the downstream sensor being downstream of the downstream assembly.

4. The yarn-drafting apparatus defined in claim 2 wherein the intermediate assembly includes another intermediate roller pair gripping the yarn downstream of the first-mentioned intermediate roller pair and upstream of the downstream roller pair, the intermediate drive means rotating both intermediate roller pairs at constant speeds with the other intermediate pair rotating more slowly than the first intermediate pair.

5. The yarn-drafting apparatus defined in claim 1 wherein each of the roller assemblies includes a second such pair of gripper rollers, the drive means including transmission means for rotating the second roller pair of each assembly at a speed forming a fixed ratio with the speed of the other roller pair of the respective assembly, with the speeds increasing in the yarn-travel direction.

6. The yarn-stretching apparatus defined in claim 1, further comprising another gripper roller assembly including at least another roller pair engaging the yarn upstream of the upstream assembly; and intermediate drive means for rotating the rollers of the other pair at a fixed speed slower than that of the upstream rollers.

7. The yarn-drafting apparatus defined in claim 6 wherein the downstream drive means includes means for increasing and decreasing the rotation rate of the downstream rollers proportionately as that of the upstream rollers increases and decreases.

8. The yarn-drafting apparatus defined in claim 7 wherein the increasing and decreasing means includes a variable-speed transmission connected to and operated by the downstream control means.

* * * * *